US005802633A

United States Patent [19]

Capaldi

[11] Patent Number: 5,802,633

[45] Date of Patent: Sep. 8, 1998

[54] PORTABLE PATIENT LIFT ASSEMBLY

[76] Inventor: Guido Capaldi, 816 S. Hughes, Howell, Mich. 48843

[21] Appl. No.: 759,142

[22] Filed: Dec. 2, 1996

[51] Int. Cl.[6] ..... A47D 7/14; A47D 7/10

[52] U.S. Cl. ..... 5/86.1; 5/83.1

[58] Field of Search ..... 5/86.1, 81.1 R, 5/85.1, 87.1, 89.1, 83.1

[56] References Cited

U.S. PATENT DOCUMENTS

| | | | |
|---|---|---|---|
| 841,702 | 1/1907 | Martin | 5/89.1 |
| 1,061,715 | 5/1913 | Allen | 5/86.1 |
| 1,641,388 | 9/1927 | Jenkins . | |
| 1,782,406 | 11/1930 | Bureau . | |
| 1,878,785 | 9/1932 | Leavitt . | |
| 2,634,431 | 4/1953 | Bickford . | |
| 2,688,410 | 9/1954 | Nelson . | |
| 2,959,791 | 11/1960 | Ramsey | 5/86.1 |
| 3,938,820 | 2/1976 | Nabinger | 280/47.11 |
| 4,117,561 | 10/1978 | Zamotin | 5/83.1 |
| 4,136,985 | 1/1979 | Taul | 403/172 |
| 4,190,233 | 2/1980 | Godfrey | 254/4 |
| 4,484,366 | 11/1984 | Koontz | 5/86.1 |
| 4,944,056 | 7/1990 | Schroeder et al. | 5/81.1 R |
| 5,158,188 | 10/1992 | Nordberg | 212/209 |
| 5,187,822 | 2/1993 | Merry | 5/86.1 |

FOREIGN PATENT DOCUMENTS

| | | | |
|---|---|---|---|
| 704508 | 5/1951 | Australia . | |
| 1461325 | 12/1961 | France . | |
| 1104138 | 4/1961 | Germany . | |
| 2275604 | 2/1993 | United Kingdom | 5/85.1 |

*Primary Examiner*—Alexander Grosz
*Attorney, Agent, or Firm*—Howard & Howard

[57] ABSTRACT

A portable patient lift assembly (10) for lifting and transporting a patient comprises a base (12), a support frame (18) extending vertically upward to top ends (20) and a lift frame (28) extending outwardly in a cantilevered fashion from a cross beam (26), and interconnecting the top ends (20). The support frame (18) includes a pair of vertical legs (22) and angled leg braces (24) which are spaced at the base (12) but overlap at the cross beam (26). The lift frame (28) includes one pair of braces (34) extending horizontally between the lift frame (28) and the joint at the ends of the cross beam (26) and the legs (22) and the leg braces (24). A second pair of braces (32) braces the lift frame (28) to the leg braces (24).

14 Claims, 3 Drawing Sheets

20
34
26
32
34
28
46
20
38
30
18
44
32
22
36
40
24

37
24
48
22
12
16
14
48
48

PORTABLE PATIENT LIFT ASSEMBLY

TECHNICAL FIELD

The subject invention relates to portable patient lift assemblies of the type for lifting, lowering and transporting a patient from one place to another.

BACKGROUND OF THE INVENTION

Health care facilities and other places that care for invalid patients require a means of assistance for lifting invalid patients in order to move the invalid patient from one place to another. For example, a patient needs to be lifted from their bed for cleaning the patient, changing the bed, or transferring the patient to a wheelchair. Systems have been proposed in the prior art for use in lifting invalid patients and moving them from room to room, floor to floor, and even building to building. The prior art includes a patient mover of the type shown in U.S. Pat. No. 5,187,822.

The prior art patient lift assemblies have not provided for economic fabrication. The prior art typically uses a frame composed of various support members to enhance stability. It is the object of the present invention to address the above mentioned problems.

SUMMARY OF THE INVENTION AND ADVANTAGES

In one embodiment, a portable patient lift assembly for lifting and transporting a patient comprises a base, a support frame extending vertically upwardly from the base to spaced top ends, a cross beam interconnecting the top ends, and a lift frame extending outwardly in a cantilevered fashion from the cross beam to a distal end. The lift frame includes sides that are spaced inwardly from the top ends of the support frame and a pair of braces to hold the lift frame on the vertical legs. The pair of braces includes upper ends and lower ends. The upper ends are attached to the sides of the lift frame and extend downwardly and outwardly to the lower ends.

A motor drives a belt that lifts or lowers the patient. The belt is guided and supported.

This assembly is easily and economically fabricated and is arranged for increased stability for lifting and moving patients.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
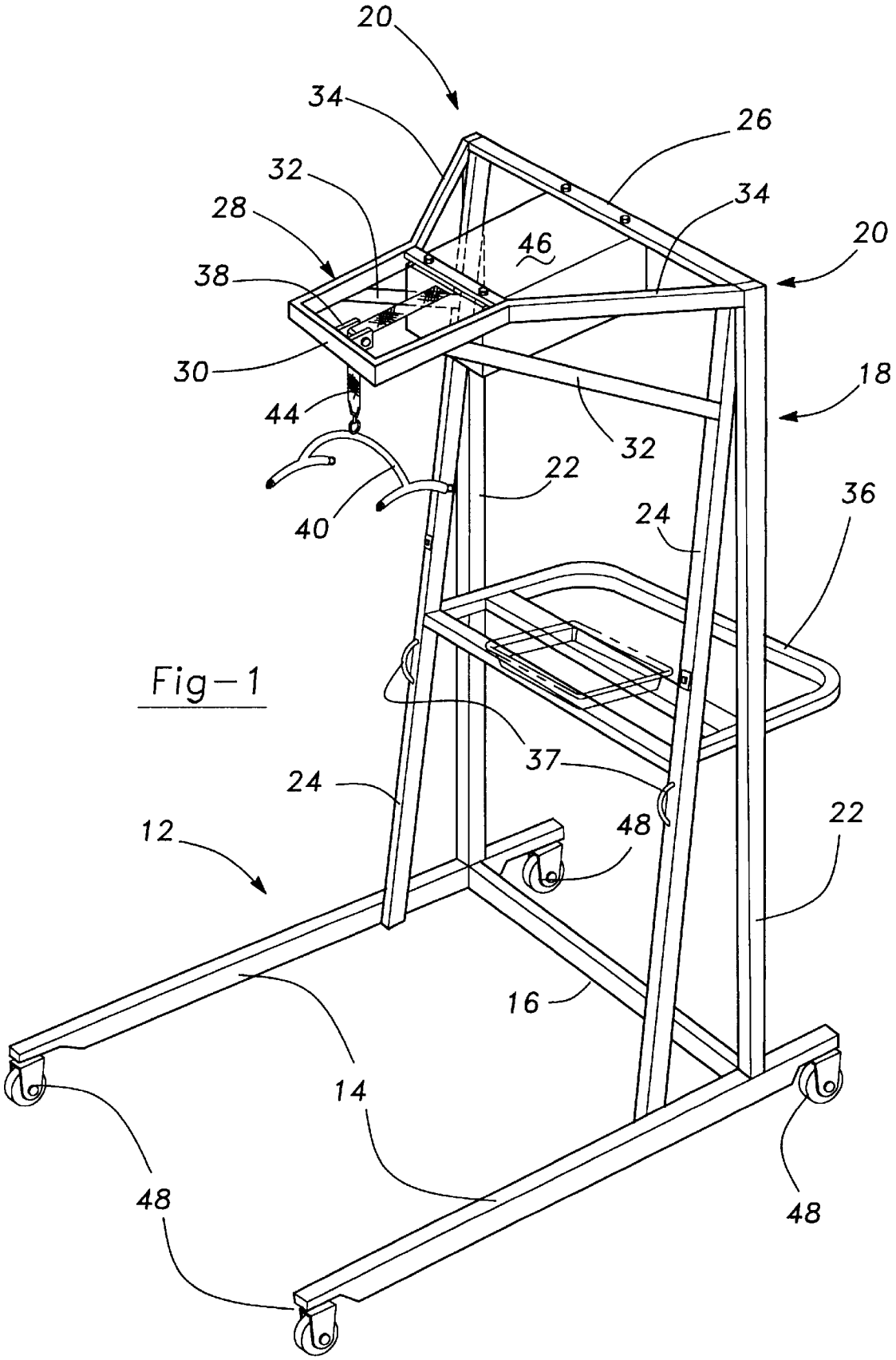
FIG. 1 is a perspective view.
Figure 2:
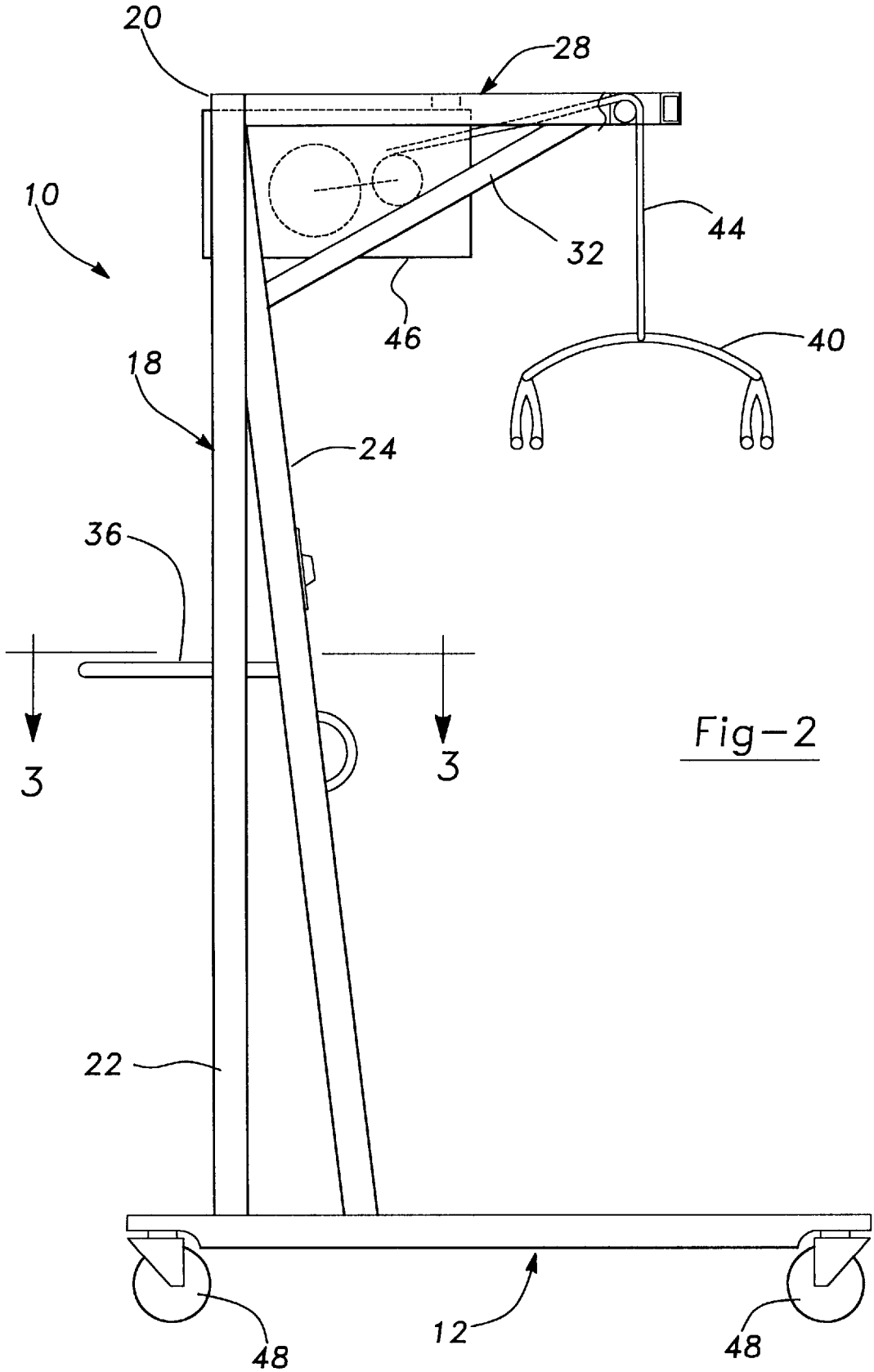
FIG. 2 is a side elevational view.
Figure 3:
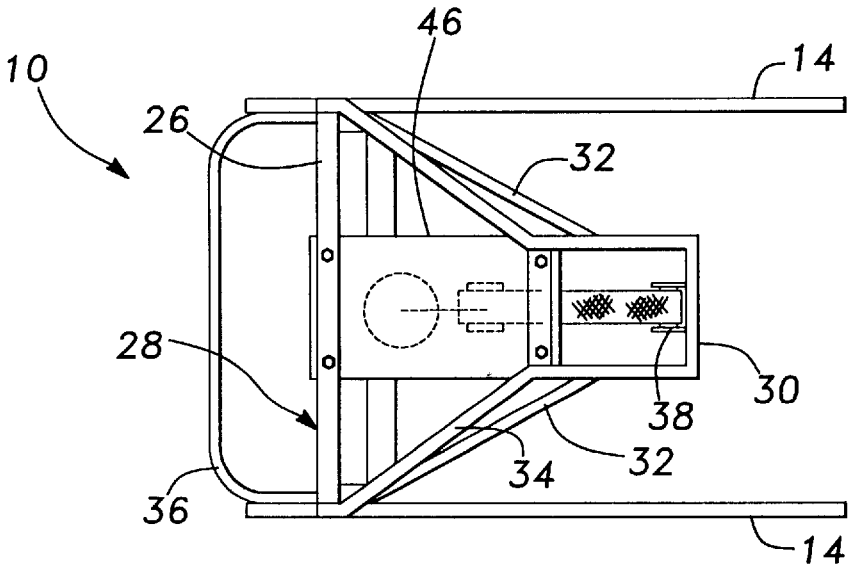
FIG. 3 is a top view.
Figure 4:
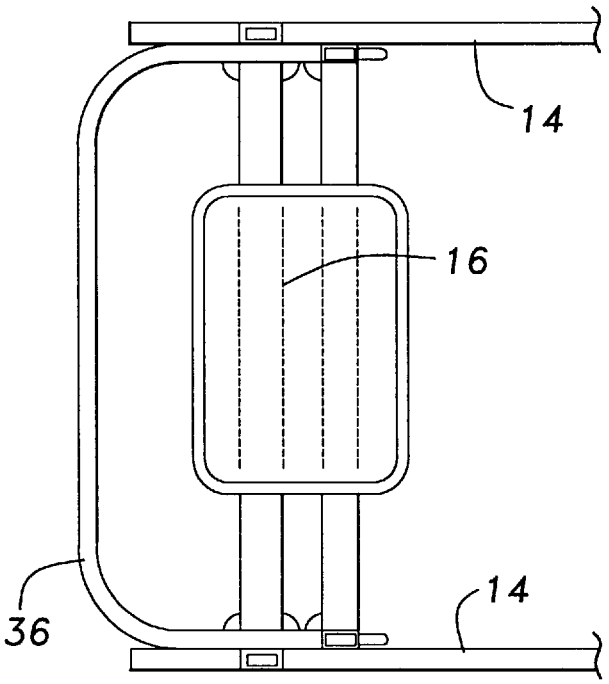
FIG. 4 is an enlarged cross sectional view taken along line 3—3 of FIG. 2.

Referring to the Figures, wherein like numerals indicate like or corresponding parts throughout the several views, a portable patient lift assembly of the type for lifting and transporting a patient is generally shown at 10. The assembly 10 comprises a base 12 having a pair of spaced horizontal beams 14 and a base beam 16 interconnecting the horizontal beams 14 to define an H shape. The horizontal beams 14 each have a top and a bottom interconnected by sides, i.e., a channel member or tubular member of rectangular cross section.

A support frame 18 extends vertically upward from the base 12 to spaced top ends 20. The support frame 18 includes a pair of spaced legs 22 extending vertically upwardly from the base 12 to the top ends 20. The support frame 18 also has a pair of spaced side leg braces 24 having bottom ends spaced outwardly from the spaced legs 22 along the base 12. The spaced legs 22 extend upwardly from the top of the horizontal beams 14 and the leg braces 24 extend upwardly from the inside of the sides of the horizontal beams 14, i.e., the leg braces 24 are offset horizontally from the legs 22. The leg braces 24 overlap the spaced legs 22 at the top ends 20 of the support frame 18 and abut a cross beam 26. Each of the horizontal beams 14, the leg braces 24, and the spaced legs 22 interconnect to form a triangular shape on the sides, in which the leg braces 24 are the hypotenuse.

A lift frame 28 includes the cross beam 26 which interconnects the top ends 20 of the legs 22. The lift frame 28 extends outwardly in a cantilevered fashion from the cross beam 26 to a distal end 30. The lift frame 28 has sides spaced inwardly from the top ends 20 of the support frame 18, i.e., the lift frame 28 is more narrow than the width of the cross beam 26.

A first pair of braces 32 connect the lift frame 28 to the support frame 18. The braces 32 of the first pair each has upper ends and lower ends to support the lift frame 28, the upper ends being attached to the sides of the lift frame 28 and the braces 32 extend downwardly and outwardly to the lower ends which are attached to the support frame 18 below the top ends 20 thereof. More specifically, the lower ends of the braces 32 abut the leg braces 24 below a joint defined by the top ends 20 of the vertical legs 22 and the leg braces 24 and the ends of the cross beam 26.

A second pair of braces 34 have outer ends and inner ends. The outer ends are attached to the sides of the lift frame 28 and are spaced inwardly from the upper ends of the first pair of braces 32. The braces 34 extend horizontally to the inner ends which are attached to the support frame 18 at the top ends 20. More specifically, the inner ends of the second pair of braces 34 abut the joint at the top ends 20 of the spaced legs 22, the leg braces 24, and the cross beam 26. Together, the first pair of braces 32 and the second pair of braces 34 support the lift frame.

The assembly 10 also includes a U-shaped handle 36 located mid-length along the spaced legs 22. The U-shaped handle 36 has a pair of arms and sides that engage the inside of the spaced legs 22 and extend to ends abutting the leg braces 24. The handle 36 supports a tray for holding items. Further, the assembly includes a pair of loops 37 located mid-length along the leg braces 24. The loops can be used for holding straps, etc. Furthermore, the assembly 10 includes a guide bracket 38 attached to the distal end 30 of the lift frame 28 for supporting a patient support bar 40. A belt 44 extends down from the lift frame 28 and supports the bar 40. The belt 44 extends over bracket 38 then downwardly to bar 40. Finally, the lift frame 28 also includes a motor 42 which is mounted on the cross beam 26 between the two pairs of braces 32, 34. The motor is housed in a motor box 46.

When a patient is lifted, the bar 40 is used to hold the patient. A sling supports the patient on bar 40. After the patient is positioned by the bar 40, the motor 42 lifts the patient. The assembly 10 moves by means of wheels 48 attached to the base 12. A set of brakes may e used to facilitate slowing down and stopping the assembly 10. However, careful use of the handle 36 may also be used for this purpose. The motor 42 only lifts and lowers the patient. A feature of the motor 42 is a solid state control. A rheostat allows the speed of lifting and lower the patient to be controlled.

A switch actuates the motor 42 and is an instant on/off switch of the type wherein the switch is normally in an off position and must be held at the "raise" or "lower" positions to actuate the motor. The motor control features include the use of low battery warning lights. The warning lights are actuated when the strength of the battery is low. The motor control also features a circuit board which receives a plug on connection. A remote control is connected to the circuit board with a wire that receives only a small control voltage. Although a higher voltage and current is utilized to power the motor, a smaller current and voltage is sent to the remote control. This allows the remote control to be safer to use than prior art systems.

The details of the motor, the bar and the sling are as shown in U.S. Pat. No. 5,511,256, or co-pending U.S. patent application Ser. No. 08/618,369 entitled "Patient Lift Mechanism".

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A portable patient lift assembly for lifting and transporting a patient comprising:

a base;

a support frame extending vertically upwardly from said base to spaced top ends;

a cross beam interconnecting said top ends;

a lift frame extending outwardly in a cantilevered fashion from said cross beam to a distal end;

said assembly characterized by said lift frame having sides spaced inwardly from said top ends of said support frame, said cross beam having ends, the first pair of braces having upper and lower ends, said upper ends attached to said sides of said lift frame and extending downwardly and outwardly to said lower ends, said lower ends attached to said support frame, below said top ends thereof;and said lift frame including a second pair of horizontal braces having outer ends and inner ends, said outer ends attached to said sides of said lift frame and spaced inwardly from said upper ends of said first pair of braces, said inner ends attached to said support frame at said top ends thereof.

2. An assembly as set forth in claim 1 wherein said support frame includes a pair of spaced side leg braces having bottom ends spaced outwardly along said base from said support frame.

3. An assembly as set forth in claim 2 wherein said support frame includes a pair of spaced legs extending vertically upwardly from said base to said top ends.

4. A portable patient lift assembly for lifting and transporting a patient comprising:

a base;

a support frame extending vertically upwardly from said base to spaced top ends;

a cross beam interconnecting said top ends;

a lift frame extending outwardly in a cantilevered fashion from said cross beam to a distal end;

said assembly characterized by said lift frame having sides spaced inwardly from said top ends of said support frame, said cross beam having ends, a first pair of braces having upper ends and lower ends, said upper ends attached to said sides of said lift frame and extending downwardly and outwardly to said lowerends, said lower ends attached to said support frame below said top ends thereof; and said support frame including a pair of spaced side leg braces having bottom ends spaced outwardly along said base from said support frame, said support frame including a pair of spaced legs extending vertically upwardly from said base to said top ends, said leg braces being spaced horizontally from said spaced legs at said base and overlap said top ends of said support frame and abut said ends of said cross beam at a joint at said top ends of said support frame.

5. An assembly as set forth in claim 4 wherein said lift frame includes a second pair of horizontal braces having outer ends and inner ends, said outer ends attached to said sides of said lift frame and spaced inwardly from said upper ends of said first pair of braces, said inner ends attached to said support frame at said top ends thereof.

6. An assembly as set forth in claim 4 wherein said inner ends of said second pair of braces abut said top ends of said spaced legs and said leg braces and said cross beam at said joint.

7. An assembly as set forth in claim 6 wherein said lower ends of said first pair of braces abut said leg braces below said joint.

8. An assembly as set forth in claim 7 wherein said base comprises a pair of spaced horizontal beams and a base beam interconnecting said horizontal beams to define an H shape, said horizontal beams having a top and sides.

9. An assembly as set forth in claim 8 wherein said spaced legs extend upwardly from said top of said horizontal beams and said leg braces extend upwardly from the inside of said sides of said horizontal beams.

10. An assembly as set forth in claim 9 including a U-shaped handle disposed at mid-length along said spaced legs, said U-shaped handle having a pair of arms engaging the inside of said spaced legs and extending to ends abutting said leg braces and having sides engaging said spaced legs.

11. An assembly as set forth in claim 10 including a guide bracket attached to said distal end of said lift frame for supporting a hoist.

12. An assembly as set forth in claim 11, wherein a motor drives a belt for lifting or lowering a patient.

13. A portable patient lift assembly for lifting and transporting a patient comprising:

a base;

a support frame extending vertically upwardly from said base to spaced top ends;

a cross beam interconnecting said top ends;

a lift frame extending outwardly in a cantilevered fashion from said cross beam to a distal end;

said assembly characterized by said lift frame having sides spaced inwardly from said top ends of said support frame, said cross beam hating ends, a first pair of braces having upper and lower ends, said upper ends attached to said sides of said lift frame and extending downwardly and outwardly to said lower ends, said lower ends attached to said support frame below said top ends thereof, further including a guide bracket attached to said distal end of said lift frame for supporting a hoist said hoist, including a electric motor driving a belt for lifting or lowering a patient; and said belt extends horizontally from said motor to a position over said bracket and then vertically downwardly past said bracket.

14. An assembly as set forth in claim 13, wherein said belt lifts a patient support bar.

* * * * *